US012110142B2

(12) United States Patent
Lizari Illarramendi et al.

(10) Patent No.: US 12,110,142 B2
(45) Date of Patent: Oct. 8, 2024

(54) MACHINE FOR THE PREPARATION OF MEDICAL PRODUCT WITH DEVICE FOR LOADING BAGS OF MEDICAL PRODUCT

(71) Applicant: KIRO GRIFOLS, S.L., Arrasate (ES)

(72) Inventors: Borja Lizari Illarramendi, Arrasate (ES); Naiara Telleria Garay, Arrasate (ES); Patxi Urtzelai Aranbarri, Arrasate (ES); Jose Ignacio Andres Pineda, Arrasate (ES); Amaia Ilzarbe Andres, Arrasate (ES)

(73) Assignee: KIRO GRIFOLS, S.L., Arrasate (ES)

( * ) Notice: Subject to any disclaimer, the term of this patent is extended or adjusted under 35 U.S.C. 154(b) by 0 days.

(21) Appl. No.: 18/321,598

(22) Filed: May 22, 2023

(65) Prior Publication Data

US 2024/0002082 A1 Jan. 4, 2024

(30) Foreign Application Priority Data

Jul. 1, 2022 (EP) ..... 22382634

(51) Int. Cl.
*B65B 3/00* (2006.01)
*B65B 35/10* (2006.01)
*B65B 43/54* (2006.01)

(52) U.S. Cl.
CPC ..... *B65B 3/006* (2013.01); *B65B 35/10* (2013.01); *B65B 43/54* (2013.01)

(58) Field of Classification Search
CPC ..... B65B 3/003; B65B 3/006; B65B 35/10; B65B 43/54; B65B 43/60
See application file for complete search history.

(56) References Cited

U.S. PATENT DOCUMENTS

2010/0017031 A1* 1/2010 Rob ..... G07F 11/54 700/239
2010/0170206 A1* 7/2010 Kim ..... B65B 61/28 53/525
2019/0031375 A1* 1/2019 Miyata ..... B65B 1/10
2021/0309398 A1* 10/2021 Kircher ..... B65B 51/227

FOREIGN PATENT DOCUMENTS

ES 2643119 B1 3/2018
KR 20160027466 A * 3/2016

OTHER PUBLICATIONS

Machine translation of KR-20160027466-A (Year: 2016).*

* cited by examiner

*Primary Examiner* — Thomas M Wittenschlaeger
*Assistant Examiner* — Himchan Song
(74) *Attorney, Agent, or Firm* — Knobbe, Martens, Olson & Bear, LLP

(57) ABSTRACT

A machine for the preparation of medical product includes a device for loading bags of medical product into the machine. The device includes a shaft with the ability to rotate and two or more adaptors for housing injection points of bags of medical product arranged on the shaft. The rotation of the shaft causes the adaptors arranged on the shaft to rotate. Two stops define a position for loading bags by an operator and an operating position of the machine.

10 Claims, 11 Drawing Sheets

MACHINE FOR THE PREPARATION OF MEDICAL PRODUCT WITH DEVICE FOR LOADING BAGS OF MEDICAL PRODUCT

CROSS-REFERENCE TO RELATED APPLICATION

This application claims priority to European Patent Application No 22382634.8 filed on Jul. 1, 2022, the disclosure of which including the specification, the drawings, and the claims is hereby incorporated by reference in its entirety.

FIELD OF THE INVENTION

The present application relates to a machine for the preparation of medical product, specifically to a machine with a device for loading bags of medical product in said machine.

BACKGROUND OF THE INVENTION

Automated machines for the preparation of medical products, such as the preparation of intravenous medication, for example, and for filling or loading medical containers, in other words containers with a medical product, are known. An example of such machines are dosing machines. These types of machines or devices are usually made up of a laminar flow cabinet and robotic means in the interior thereof which performs the necessary movements for removing medicine from a source container and injecting said medicine into end medical containers. The medicine is injected into the medical containers through an injection or dosing point located on the medical container.

These machines may comprise a worktop with holes for introducing the dosing points of the medical containers. Once introduced, robotic means of the machine fill the various medical containers by introducing the medical product into a dosing point of the container. In this type of dosing machine with a worktop, the robotic means for filling containers are positioned inside the machine, beneath the worktop and arranged below the containers such that the dosing point of the medical container is situated below the worktop. Other types of dosing machine may use safety barriers which separate the load from the robotic means without using a worktop.

A problem with dosing machines that have a worktop is the introduction or loading of the medical containers into the machine. Most dosing machines are designed for filling a specific type of medical container and comprise supports for said type of container. However, a very sought-after characteristic of these machines is to have flexibility for loading various types of containers. Machines are known that allow different types and makes of end medical containers to be supported, in which the dose of the preparation is introduced using specific adaptors for each container arranged in holes in the machine, which offer great flexibility of use and allow batch working for different types of end medical containers (syringes, bags, infusers, cassettes, etc.). These adaptors must be introduced into the adaptor supports of the machine before beginning a batch of preparations. Spanish patent document ES2643119 B1 discloses an example of an adaptor for a dosing machine.

A known method for loading containers consists in the operator removing the adaptors from the machine, introducing the medical containers into the adaptors and then placing the adaptors, with the containers incorporated, back into the supports for said adaptors of the machine. Said current manual placing method has the drawback of having to remove and place all the adaptors of the machine before preparing a batch. Therefore, when producing long batches, which is one of the most common applications of this type of machine, where high productivity is particularly valued, loading and unloading the containers individually becomes slow and tedious.

Another known method of loading containers consists in first arranging the adaptors in their supports in an operating position of the machine and then placing the containers therein. In the case of a dosing machine with a worktop, the adaptors of the machine are placed such that the dosing points of the containers are arranged towards the inside of the machine once positioned and the containers are then placed in the adaptors without being removed.

If the medical containers are bags, in said machine operating position the bag adaptors are positioned beneath the worktop so that the bag can be filled through the dosing point. There is therefore very little space for the operator to be able to introduce the bags, which is very inconvenient. Moreover, it is difficult to see the connection point as the dosing point of the machine is below the visual field of the operator. This may result in poor positioning of the dosing point of the bag.

SUMMARY OF THE INVENTION

An object of the present invention is to disclose means for facilitating the introduction of the containers into the machine, to achieve greater speed in loading medical containers, a reduction in the force required from the operator when loading the material, and a reduction in the level of concentration required of the operator to load the material correctly. Another object is to disclose means that make it possible to work both in batch mode and in patient-specific mode (a specific preparation for a particular patient), in other words, making use of different types of end containers and/or doses in the same loading cycle (in this case, the same type of medicine is dosed on each line of the machine).

More specifically, the present invention discloses a machine for the preparation of medical product which has a device for loading a medical product in said machine. Said device comprises a shaft with the ability to rotate, a plurality of adaptors for housing injection points of bags of medical product which are arranged on the shaft, such that the rotation of the shaft causes the adaptors to rotate. The device also comprises two stops which limit the rotation of the shaft. Said stops define a position for loading bags by an operator and an operating position of the machine.

The present invention therefore discloses a machine that allows bags to be placed in the adaptors of the device in a first loading position. From said loading position, the device allows the adaptors to rotate in order to place said adaptors in an operating position of the machine in which the dosing point of the bags is positioned in the correct direction for filling. This allows the bags to be placed in the adaptors in a convenient loading position for the operator, and also increases the visibility of the connection point for the operator during loading, while allowing subsequent rotation thereof in order to position the adaptors, and therefore the dosing points of the bags, in the operating position.

Preferably, the operating position of the machine is a position in which the injection points of the bags are positioned beneath the worktop of the machine.

Preferably, the device for loading bags comprises a lever mechanically connected to the shaft, actuation of the lever causing the shaft to rotate.

Preferably, the device comprises a guide, the ends of which define the stops. More preferably, the lever comprises a protrusion, said protrusion of the lever being housed in the guide, such that the protrusion is guided by said guide during the actuation of the lever. Still more preferably, the guide comprises a curved central segment and end segments situated at the ends of the central segment, there being a change of direction between the central segment and the end segments, such that the end segments correspond to the bag loading position and the operating position of the machine. In an especially preferred way, the lever comprises an actuator with a pusher and elastic position recovery means for the pusher, such that the actuator allows the relative position of the protrusion with respect to the lever to be modified, facilitating the passage of the lever from the end segments to the central segment and vice versa.

The end segments, particularly in combination with the actuator, allow the position of the device at the ends of the guide to be locked, such that the protrusion cannot pass accidentally from the end segments to the central segment without previously actuating the actuator.

Preferably, the end segments are arranged so as to extend perpendicular to the rotational movement of the lever. This means that while the protrusion is positioned in an end segment, it is not possible to rotate the shaft.

Preferably, the device is in the form of a tray. Also preferably, the device for loading bags of medical product may comprise handles for manual handling. Also preferably, the guide may be arranged in one of said handles.

Preferably, the machine is a machine for dosing medical products, more preferably, for dosing intravenous medicines, still more preferably non-cytostatic intravenous medicines (for example, antibiotics or anaesthetics). Preferably, the machine comprises at least one hole for introducing the injection point of bags of medical product for filling, said hole being arranged in or below a worktop of said machine.

Preferably, the plurality of adaptors is arranged on the upper portion of the shaft. In this way, the positioning of the dosing points of the bags in their housings on being introduced into the device of the machine is facilitated. Preferably, the adaptors are adaptors for bags. More preferably, the adaptors are adaptors for bags with a Luer-Lock termination (also known as a Luer-Lock connector). Alternatively, the adaptors are adaptors for bags with another type of connector or termination. In this other type of bag, the dosing point could be accessed, for example, by the robotic means of the machine using a needle. Preferably, the shaft is cylindrical. Alternatively, the shaft is cylindrical in part.

Preferably, the shaft is housed inside a housing of the lever, and is secured thereto by dimensional interference, for example. More preferably, the shaft comprises planar faces in the area housed in the housing in order to produce said dimensional interference during the rotation of the lever and shaft. More preferably, comprises the shaft comprises at least four of said planar faces. Preferably, the portion of the shaft connected to the lever is an end of said shaft.

Preferably, the adaptors comprise push-fitting means for the injection points of the bags of medical product. More preferably, the adaptors comprise an area of the housing which comprises at least one planar face, said adaptor comprising push-fitting means for at least one valve of at least one bag with a Luer-Lock termination. Said planar face helps ensure that the bags with a Luer-Lock termination do not rotate. Alternatively, the adaptors might not comprise an anti-rotation system. Preferably, the adaptor comprises an upper stop. Said upper stop improves the securing of the bag.

Preferably, the device for loading bags of medical product is removeable. More preferably, the device for loading bags of medical product comprises fastening means to the worktop of the machine. Still more preferably, said fastening means comprise claws arranged on the lower portion of the device, said claws being L-shaped such that the distal portion of the claw is beneath the worktop after placing the device on said worktop. Preferably, the device comprises a rear portion for the arrangement thereof on the worktop of the machine. More preferably, the device comprises connection structures between the rear portion and the shaft.

Preferably, the machine comprises a cross-piece for supporting the bags of medical product in the operating position of the machine. More preferably, said cross-piece is positioned on the device for loading bags. More preferably, the cross-piece comprises at least one side segment, said side segment being arranged on a connection structure of the device. When the bags are positioned, depending on the length of the bag, the worktop may be covered, making it difficult to see said worktop. Said cross-piece allows the bags to be supported to avoid said visual interference. Still more preferably, at least one side segment of the cross-piece comprises a groove, said groove of the cross-piece being arranged preferably at an end of the side segment in contact with the connection structure of the device. In addition, the connection structure comprises a through-element arranged in said groove, the dimensions of the groove being greater than those of the through-element. Movement of the cross-piece allows extension thereof into a vertical position to give support to the bags or the compressed arrangement thereof.

Furthermore, the groove with the through-element allows the cross-piece to fall by gravity until positioned on the through-element at the moment when a vertical position is adopted, locking or preventing unwanted movement thereof during operation.

Preferably, the device comprises radiofrequency identification (RFID) tags. Said tags allow the various elements such as containers, adaptors or supports for said adaptors to be identified. The use of RFID antennae or tags allows the types of adaptors loaded into the machine to be identified and provides confirmation that it is the correct container type (bag, syringe, infuser, cassette, etc.) where the dose should be injected.

The present invention also discloses a method for loading bags of medical product into a machine for the preparation of medical product according to any one of the preceding claims, which comprises the steps of:

a. Placing the device in the bag loading position for the operator,
b. Fastening the bags in the adaptors,
c. Rotating the shaft from the operator bag loading position to the machine operating position. At this moment, the machine can inject the medical product into the dosing points of the bags. Preferably, the shaft is rotated by actuating the lever of the machine.

As used in the present document, the term "medical container/s" refers to any type of container used in medicine for storing, preparing or administering medicines (for example, intravenous medicines, such as non-cytostatic intravenous medicines including antibiotics and anaesthetics) and other solutions used in intravenous treatments (such as physiological solutions, saline solutions or nutritional solutions). The concept "medical product/s" is used in the present document to refer to these medicines and other solutions.

As used in the present document, the terms "dosing point/s" and "injection point/s" refer to the point or element of the medical container through which said container is dosed, in other words, the point through which the medicine (preferably intravenous medicines, such as non-cytostatic intravenous medicines including antibiotics and anaesthetics) or intravenous treatment solution (such as physiological solutions, saline solutions or nutritional solutions) is introduced into the medical container.

With regard to the types of medical containers, bags with a Luer-Lock termination are known, the dosing points of the bags are situated in their valves, which are the dosing point thereof. The Luer-Lock system is a standardised thread system for medical devices and fluid accessories such as syringes, bags, infusion equipment, etc. which comprises a closure with a rotating thread to allow syringes, bags, etc. from different manufacturers to be combined, facilitating the fastening of the actuators of the machine (for example, needles) to the dosing point. Also known are bags without a Luer-Lock termination. This type of bag does not comprise valves, unlike bags with a Luer-Lock termination.

As used in the present document, the term "push-fitting means" and its plural refers to conjugate structures which interact by elastic spatial interference. One of the structures resists the passage of the other, forcing the other to move slightly on its vertical axis and/or horizontal axis in order, once introduced into the structure that provides resistance, to return to its position. The terms "push-fitting", "push-fitting structure" and their plurals and similar terms will be interpreted in accordance with the definition given for "push-fitting means" and its plural.

BRIEF DESCRIPTION OF THE DRAWINGS

For a better understanding, the accompanying drawings of an embodiment of the present invention are given as an explanatory but non-limiting example.

DETAILED DESCRIPTION OF THE PREFERRED EMBODIMENTS

Figure 1:
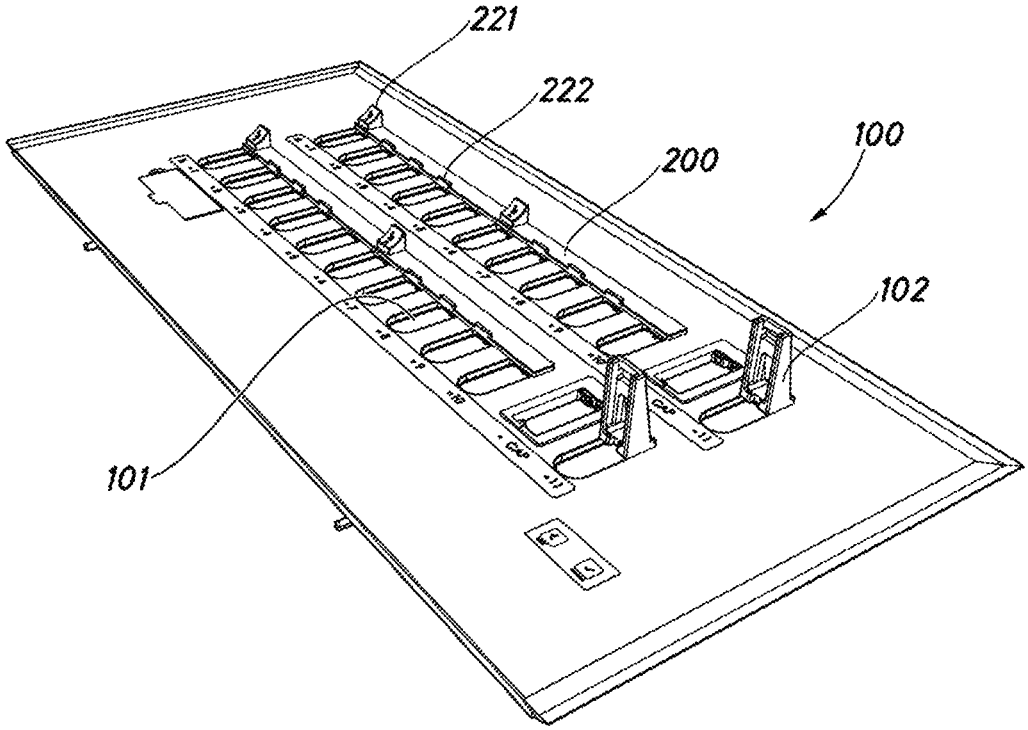
FIG. 1 is an example of a worktop of a machine for the preparation of medical containers according to the present invention.

FIG. 1 shows a portion of a machine 1000 for the preparation of medical products, specifically a worktop 100 of a dosing machine.

The worktop comprises holes 101 for loading medical containers, more specifically for the introduction of the dosing points of medical containers. These holes allow the introduction of supports for any type of medical container such as bags or syringes, or the introduction therein of fixed supports 102, such as universal supports used for different types of medical containers. These fixed supports 102 serve to position the dosing points of medical containers. Alternatively, the worktop may comprise a single hole.

FIG. 1 shows only two fixed supports 102 situated at one end of the worktop. These fixed supports 102, one for each work line, allow the dosing points of a source container from which the medical containers positioned in the holes 101 are filled with the medical product to be positioned. Alternatively, the machine may comprise a different number of work lines, or a different number of holes in each line. The worktop is shown separated from the machine for illustrative purposes, and it should be understood that the worktop forms part of a machine for the preparation of pharmaceutical products, for example of a known type.

The worktop 100 of the machine comprises a support 200 for attaching the loading device. The worktop may comprise various lines, each with a respective fastening support 200 and holes 101. Multiple lines allow various batches of containers to be filled at the same time. Each fastening support 200 comprises an actuator or retention element 221 and protruding teeth 222 for interconnection with a device for loading medical containers. Said fastening support 200 should be understood as an element of the machine that facilitates the fastening of the device to the rest of the machine.

FIGS. 2 to 9 show a first example of a device for loading bags of medical products of the machine.

Figure 2:
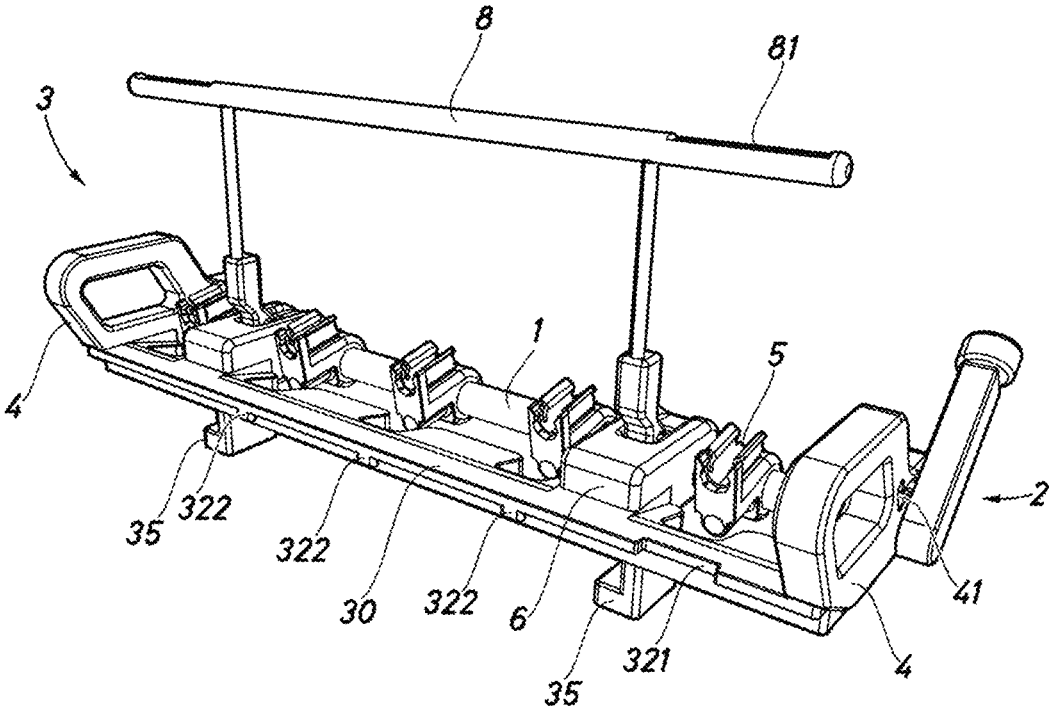
FIG. 2 is a first perspective view of a device for loading bags according to a first embodiment of the machine.
Figure 3:
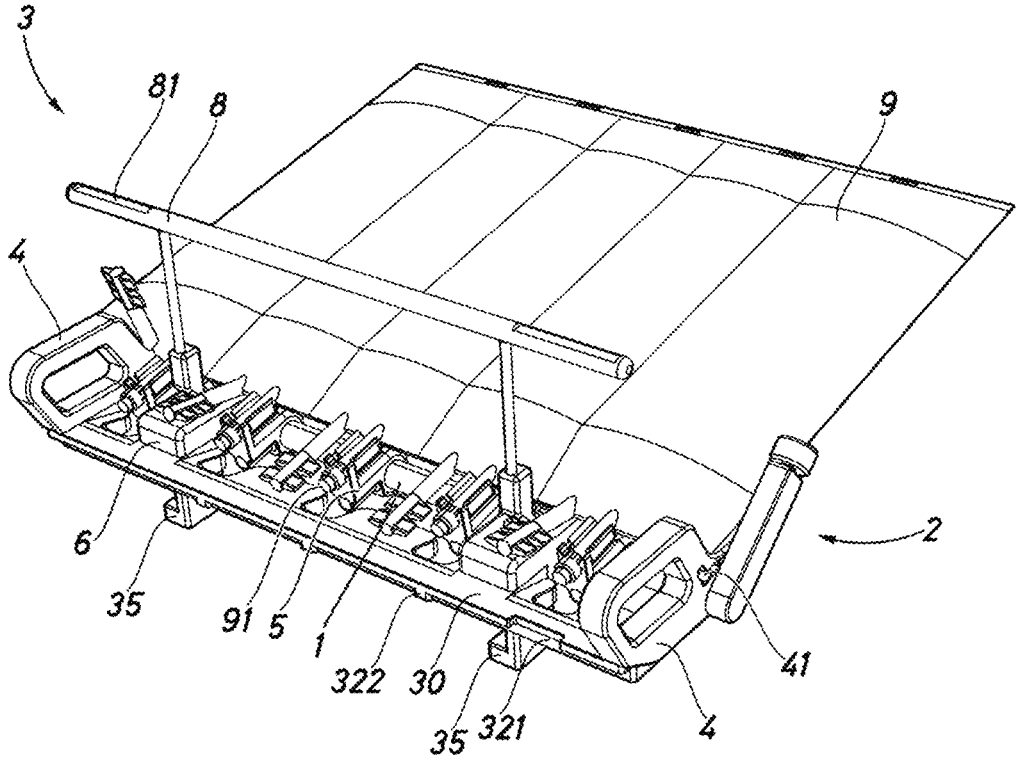
FIG. 3 is a second perspective view of the first device in FIG. 2, with the bags placed in a horizontal position.

As can be seen in FIGS. 2 and 3, the device 3 comprises a shaft 1 with the ability to rotate and a plurality of adaptors 5 for housing therein injection points 91 of bags 9. Said adaptors 5 are arranged on the shaft 1 and rigidly connected thereto. The adaptors 5 in the example are adaptors for bags with a Luer-Lock termination, which comprise a housing for inserting a valve or injection point of a bag and push-fitting means for securing said valve in the adaptor, facilitating the filling or loading of the bag. Alternatively, the adaptors could be adaptors for bags with another type of termination. The presence of a plurality of adaptors allows the bags to be loaded and/or filled in batches. FIG. 2 shows the device without bags in the adaptors, while FIG. 3 shows the device with the bags 9 arranged in the respective adaptors 5.

The device 3 comprises a rear portion 30 intended to be placed in the support 200 of the worktop 100 of the machine and connection structures 6 between the rear portion 30 and the shaft 1 which gives the device robustness. In the context of this patent, it should be understood in the expression "rear" to the portion which is positioned farthest from the operator once the device or tray is placed in the machine, while the "front" portion is the one that is closest to the operator during the operation of loading bags into the machine. The device also comprises, at the ends thereof, two handles 4 which, in this case, are connected to the rear portion 30 of the device and with the shaft 1. Alternatively, said device might not have handles, or could have walls instead of handles.

The device 3 comprises a lever 2 rigidly connected to the shaft 1, actuation of the lever 2 causing the shaft 1 to rotate. Said lever 2 may be arranged on the right or on the left of the device 3. The handles 4 comprise a housing in the lower portion thereof (not shown) which houses the shaft 1 such that said shaft is rigidly connected to the lever. One of the handles 4 is positioned between the portion of the shaft which comprises the adaptors 5 and the lever 2. The shaft 1 in the example has a cylindrical cross section although, alternatively, the shaft could have other cross sections, such as a cam-type cross section to confer a given trajectory on the bags.

The device 3 of the machine comprises a guide 41 with a curved central or main segment. In the example, the guide is arranged on a handle 4 of the device. The distal ends on the guide 41 define two stops to the rotation of the shaft. The stops define a bag loading position for the operator and an operating position of the machine.

The lever 2 also comprises a protrusion 24 which acts as a through-element. Said protrusion 24 of the lever 2 is situated or housed in the guide 41, so as to pass through said guide. When the lever is actuated, the protrusion 24 travels through the guide 41. Moreover, actuating the lever causes the shaft 1 to rotate. The rotation of the shaft in turn causes the adaptors 5 to rotate conjointly. The guide 41 and the lever 2 are shown positioned on the left portion of the device (seen from the position occupied by the operator during loading). This position is more ergonomic for the operator, although in another position said guide and lever could be on the right of the device.

The device 3 also comprises a cross-piece 8 for supporting the bags of medical product. In the example, the cross-piece is situated on said structures 6. The cross-piece provides support for the bags once the machine is in the operating position. The cross-piece 8 may be moveable and may be extended and retracted. The cross-piece may also comprise grasping areas 81 to make it easier for the operator to push the cross-piece downwards in order to extend and retract said cross-piece.

The device or tray 3 also comprises fastening means to a machine for the preparation of containers of medical products. In the embodiment shown, said fastening means are arranged at the bottom of the rear portion 30 of the device, and comprise protrusions 322 or teeth intended to produce dimensional interference with a protrusion of the attachment support 200 of the machine, claws 35 with an L-shape such that the distal portion of the claw is below the worktop after the device is placed on said worktop, intended to produce dimensional interference with the lower portion of the worktop, preventing the device from moving upwards once the device 3 is placed in the machine, and a groove 321 for the introduction of a retention element 221 of the attachment support 200 of the machine. However, the invention is not limited to these types of attachment means and other known attachment means may also be used.

Figure 4:
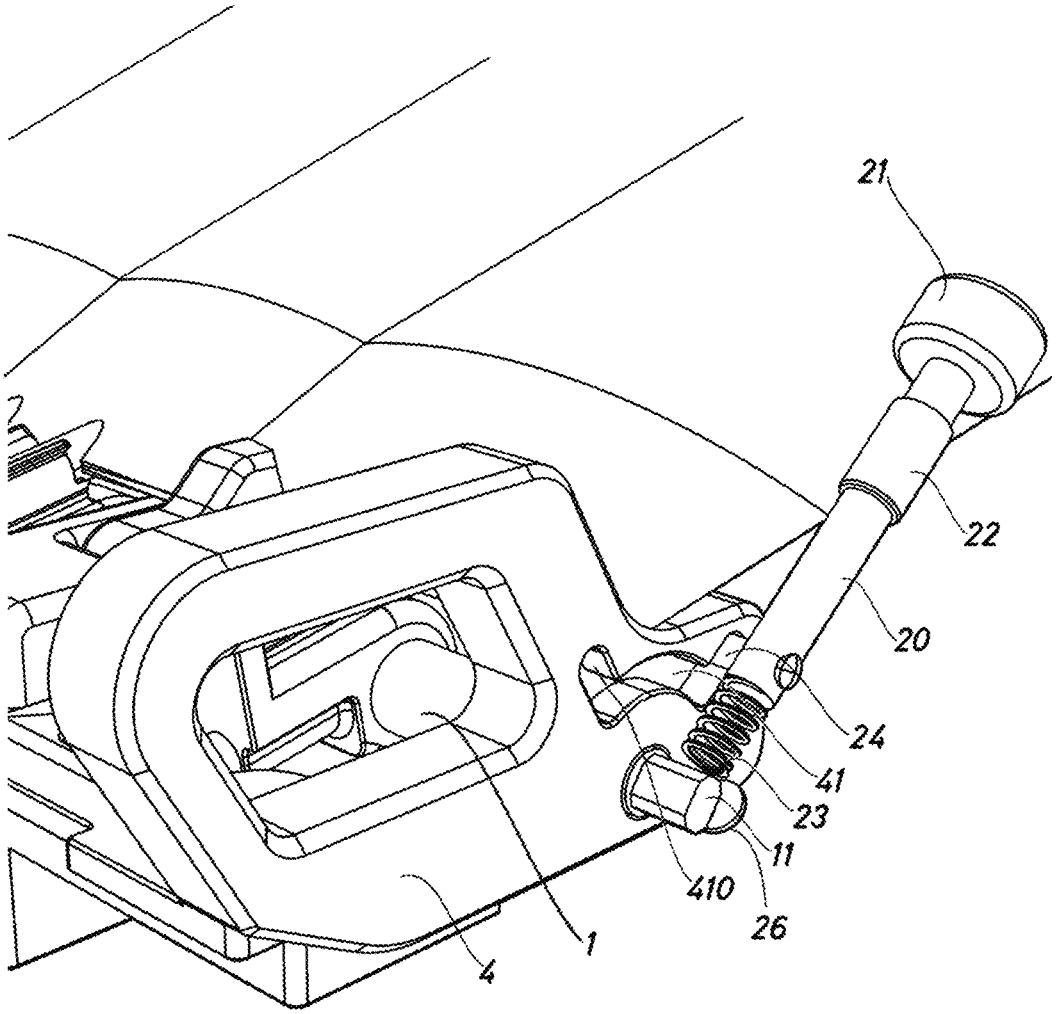
FIG. 4 is a detail in perspective of the lever of the device, without the casing of the lever, in the position for loading bags into the machine.

FIG. 4 shows the guide 41 in more detail. In the figure, the casing of the lever has been omitted for illustrative purposes and the cross-piece is retracted so as not to obstruct the view. The device is shown in the bag loading position, with the adaptors 5 positioned such that the bags are placed in a position parallel to the plane of the worktop of the machine. As can be seen, the lever 2 comprises a protrusion 24 positioned on the guide 41 situated on the handle 4. Because the shaft 1 is rigidly connected to the lever 2, the movement of the protruding element 24 in the curved area of the guide 41 of the tray causes the conjoint rotation of the shaft 1, rotating all the adaptors 5 in unison at the same time. This movement allows the adaptors to rotate to an operating position of the machine in which the adaptors are positioned such that a bag housed in the adaptor is placed with its injection point in a position perpendicular to the plane of the worktop of the machine. These two positions correspond to stops defined by the ends of the guide 41. The guide 41 comprises end segments 410 situated at each end of the central segment, there being a change of direction between the central segment and the end segments. Said end segments 410 cause locking in order to limit the movement of the protrusion 24 in said positions, and correspond to the bag loading position for the operator and the machine operating position.

FIG. 4 shows that the lever comprises a main body 20 and that the protrusion 24 is mechanically connected to the main body 20 of the lever, jutting out perpendicular thereto. FIG. 4 also shows that the lever 2 comprises a pusher 21 at its distal end and a spring 23, which is an elastic means of recovering the position of the pusher, arranged on a piston inside the main body 20 the lever 2, and has no mechanical contact with the shaft 1 arranged in a lower housing (separation thereof being provided by the casing, which is not visible in the figure). The lever 2 also comprises a bush 22 which helps reduce friction during the movement of the pusher 21. By pressing the pusher 21, the protrusion 24 travels along the outer segment 410 of the guide to the curved area of the guide . . . . Moreover, by pressing the pusher, the spring 23 is compressed, such that on raising the pusher the protrusion 24 returns to its position in the outer segment 410 of the guide. The lever 2 also comprises a threaded stud, which passes through a portion of the lever and is threaded onto the end 11 of the shaft 1 to enhance the coupling of the shaft 1 to the lever, the lever comprising a stopper 26 to access said stud.

FIG. 4 also shows an end 11 of the shaft 1. The shaft 1 is housed inside a housing or groove (not shown). The shaft is mechanically secured to the lever by dimensional interference between the shaft and the housing. The end 11 shown has a rectangular cross section, having four external planar faces, whereas the housing is generally rectangular to facilitate transference of the rotation between lever 2 and shaft 1. The end 11 may comprise bevel edges, for example, between the planar faces which also facilitates movement transference between the shaft and the lever. The housing for the shaft and the end of the shaft may have any conjugate shape that allows transmission of the rotation between said elements.

FIG. 4 shows the various elements in the bag loading position, in which the adaptors are in a first horizontal position to facilitate the loading of the bags in said adaptors. The protrusion 24 of the lever 2 is situated in the outer segment 410 of the guide situated in the frontmost portion of the device. This position is much more ergonomic for the operator than a position with the housings of the adaptors in a position perpendicular to the worktop. Moreover, the adaptors are arranged above the portion 30 of the device, facilitating correct loading of the dosing point.

Once the points of the bags are loaded, the operator presses the pusher 21, moving the protrusion 24 from the end point of the outer segment 410 of the guide to the beginning of the central segment of the guide 41, which in turn compresses the spring 23. Once in the curved central segment of the guide 41, the operator rotates the main body 20 of the lever, which in turn causes the shaft to rotate and in turn the adaptors and the injection points of the bags rotate until positioned in the device operating position. At the same time, the protrusion travels along the central segment of the guide until reaching the other end segment.

Figure 5:
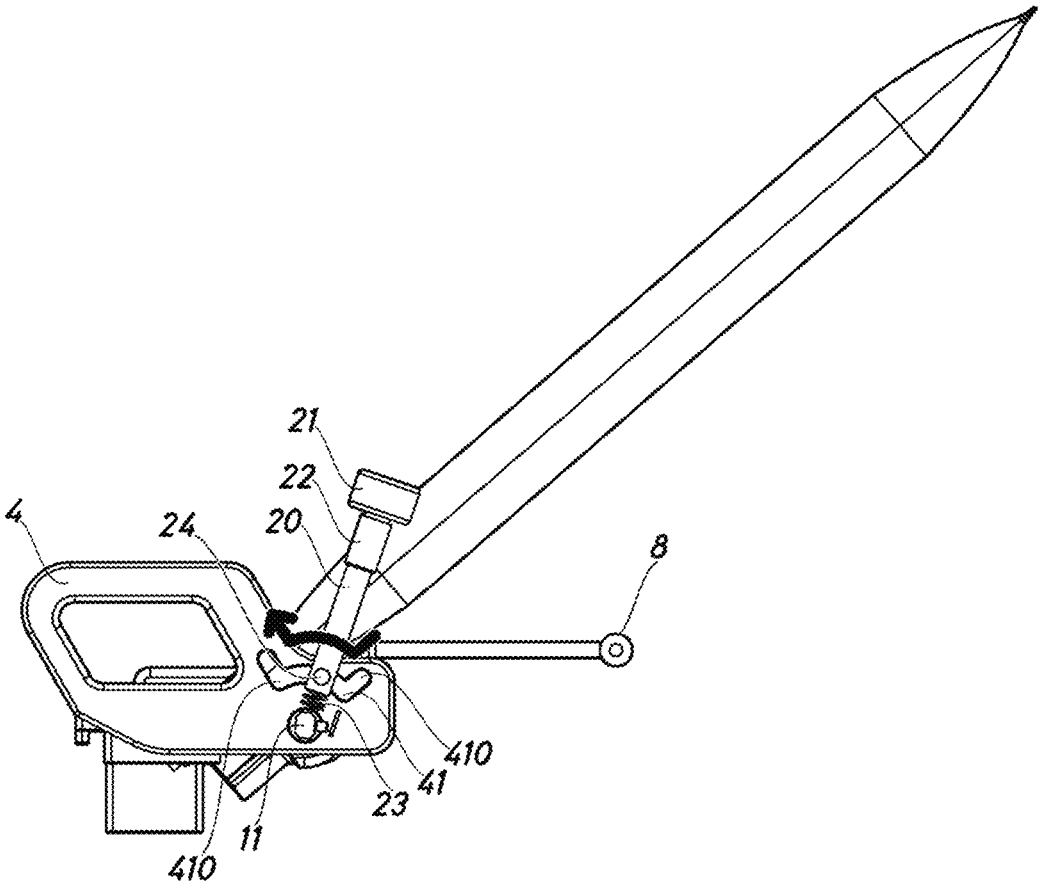
FIG. 5 is a perspective view of the device in FIG. 2 during rotation of the lever, without the lever casing.

FIG. 5 shows the position of the various elements at an intermediate point of the movement of the protrusion 24 along the guide 41, with the pusher and the spring compressed, and also shows the trajectory followed by the protrusion through the guide 41 (indicated with an arrow).

Figure 6:
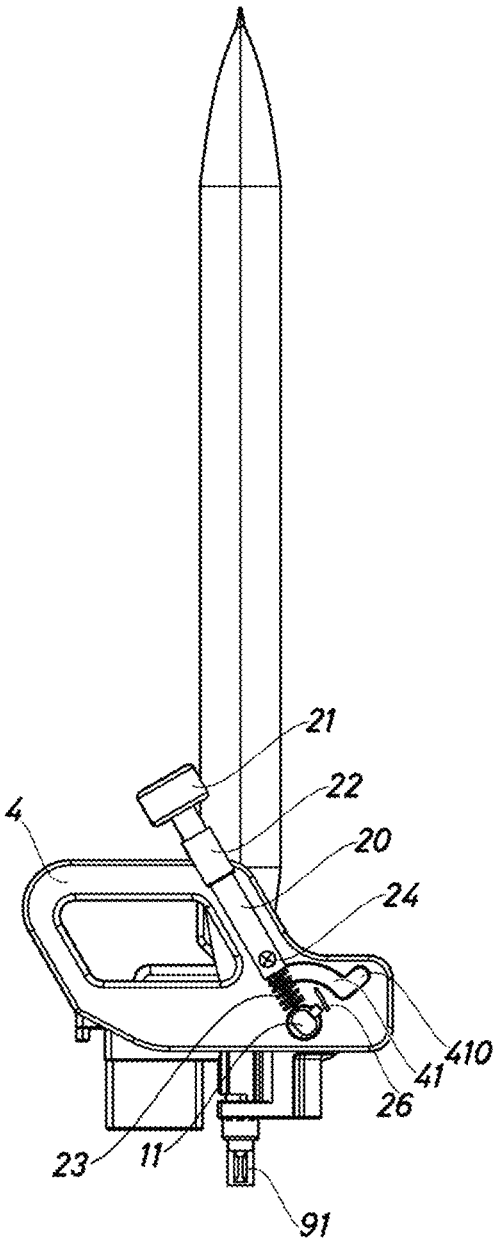
FIG. 6 is a perspective view of the device in FIG. 2, without the lever casing, after rotation into the operating position of the machine.

FIG. 6 shows the position of the device following the complete movement of the protrusion 24 through the guide 41 and the raising of the pusher 21 which decompresses the spring 23. After reaching the other end of the central segment of the guide, the operator raises the pusher 21 causing the spring 23 to decompress, which moves the protrusion 24 leaving said protrusion locked at the end point of the rear end segment of the groove 41, which prevents accidental movement thereof and therefore a possible accidental rotation of the shaft 1 while the bags 9 are being filled. As can be seen, following the movement of the protrusion 24 through the guide 41, the bags and their injection points are positioned vertically, in the operating position required to connect with the robotic filling means of the machine. The bags are resting on the worktop during the automatic cycle, or on the cross-piece 8 (shown raised in the figure to make it easier to understand the invention). Once the bags have been filled, the operator presses the pusher again and rotates the lever to return to the initial loading position. At this moment, the operator can unload the bags by removing in an upward direction the injection points thereof situated in the adaptors.

To sum up, the device allows easy and uncomplicated loading for the operator, who only has to place the device in the operator bag loading position, once in said position, secure the bags in the adaptors, and then rotate the lever from the operator bag loading position to the machine operating position.

Figure 7:
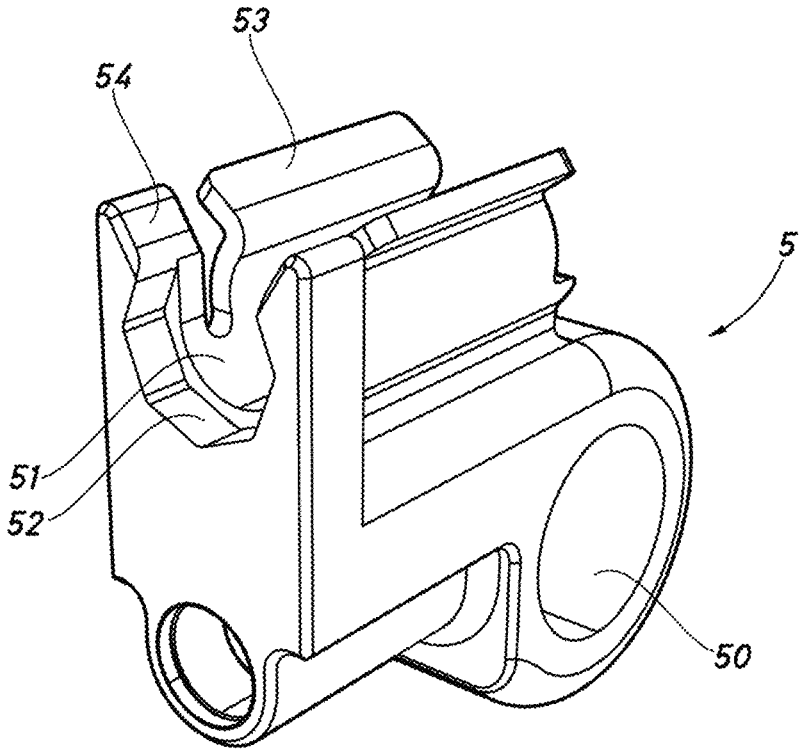
FIG. 7 is a perspective view of an adaptor for bags with a Luer-Lock termination.
Figure 8:
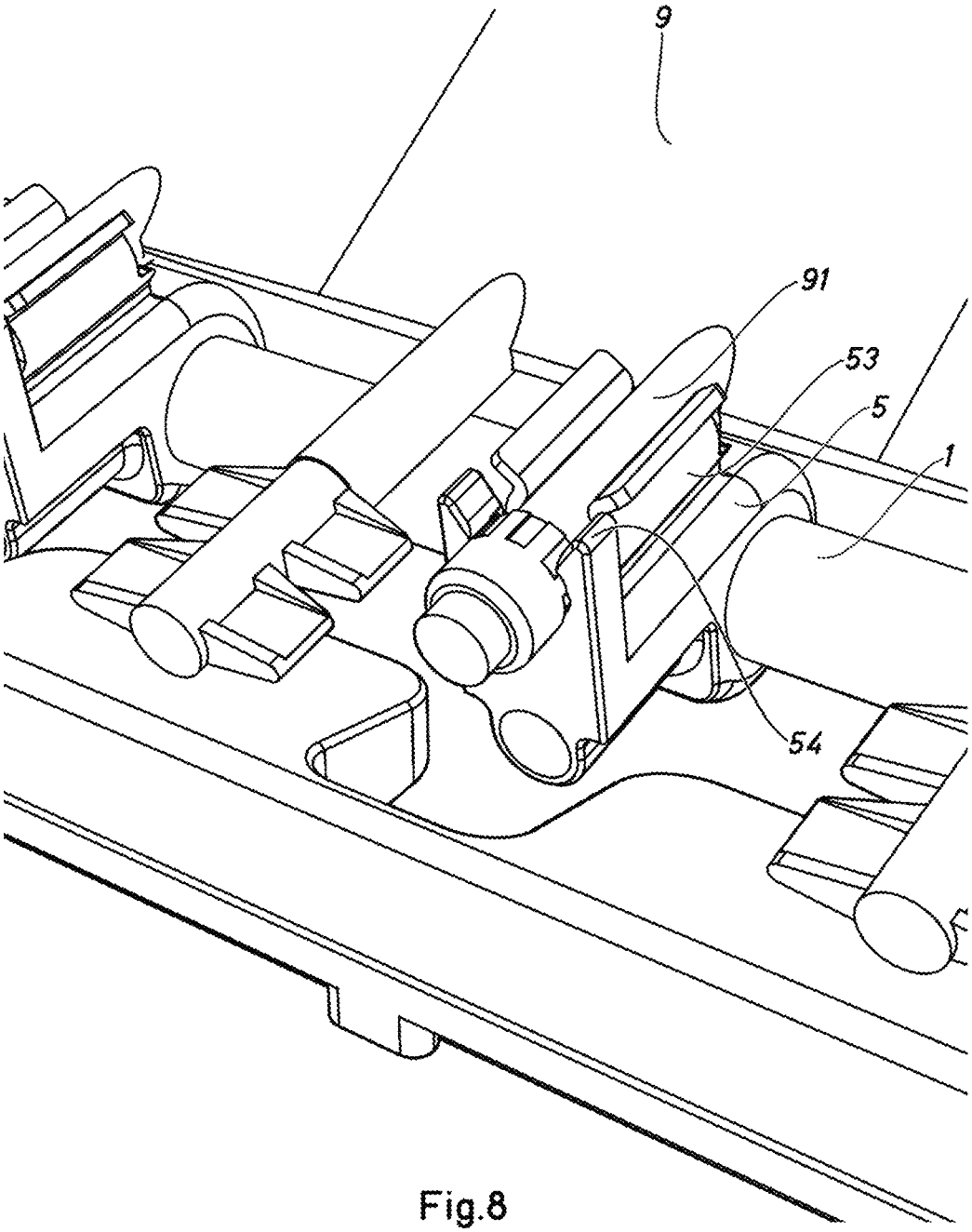
FIG. 8 is a detail in perspective of the adaptor for bags in FIG. 6 with a bag arranged in a housing thereof.

FIGS. 7 and 8 show an adaptor for bags with a Luer-Lock termination according to the device of the invention. Specifically, FIG. 7 shows an adaptor 5 with no bag in the housing 51 thereof while FIG. 8 shows an adaptor with a dosing point 91 of a bag 9 placed in the housing thereof.

In FIG. 7, the adaptor 5 comprises a housing 51 for the valve or the injection point of a bag, and also push-fitting means 53 to ensure correct positioning of the dosing point in the housing. The push-fitting means of the housing allow the dosing point of the bag to be secured in the adaptor, while in turn facilitating the removal of said dosing point when the operator applies an upward force. This allows the dosing point to be secured but also easy to remove.

The adaptor 5 also comprises an anti-rotation system. Accordingly, an area of the adaptor 5 comprises various planar faces 52. These planar faces impede the lateral movement and rotation of the valves or injection points of bags with a Luer-Lock termination once positioned in the housing and push-fitted therein. More specifically, said area of the housing comprises planar faces of a shape conjugate with a transverse cross section of the valve of the bag, so as to prevent movement of the dosing point of the valve of the bag. In the case of bags with no Luer-Lock termination, the adaptor could, for example, have no anti-rotation system and the dosing point could be accessed by the robotic means of the machine using a needle.

The rear portion of the adaptor 5 also comprises a claw 54 which acts as an upper vertical stop which makes it difficult for the valve to be able to leave its position. The valve is placed in the adaptor by introducing the dosing point into the push-fitting means 53 and positioning the valve in the portion that includes the planar faces and the upper vertical stop 54.

FIG. 7 also shows that each adaptor comprises a through-hole 50 which receives the shaft 1. Accordingly, the dimensions of said hole correspond to those of the shaft 1, such that the adaptor 5 is secured with respect to the shaft. In this way, the rotation of the shaft allows the conjoint rotation of the adaptor, allowing the dosing point of the bag, and therefore the actual bag, to be placed in the container loading and operating positions as required. The mode of securing the adaptor 5 to the shaft 1 may be any known fastening means, such as by screwing. Said screwing would make it easier to remove the adaptors for possible maintenance or replacement. Other attachment means are also possible. Alternatively, the adaptor may form an integral part of the shaft.

FIG. 8 shows a dosing point 91 belonging to the valve of a bag 9 placed in the housing 51 of an adaptor 5. As can be seen, the dosing point 91 is push fitted using the push-fitting means 53.

Figure 9:
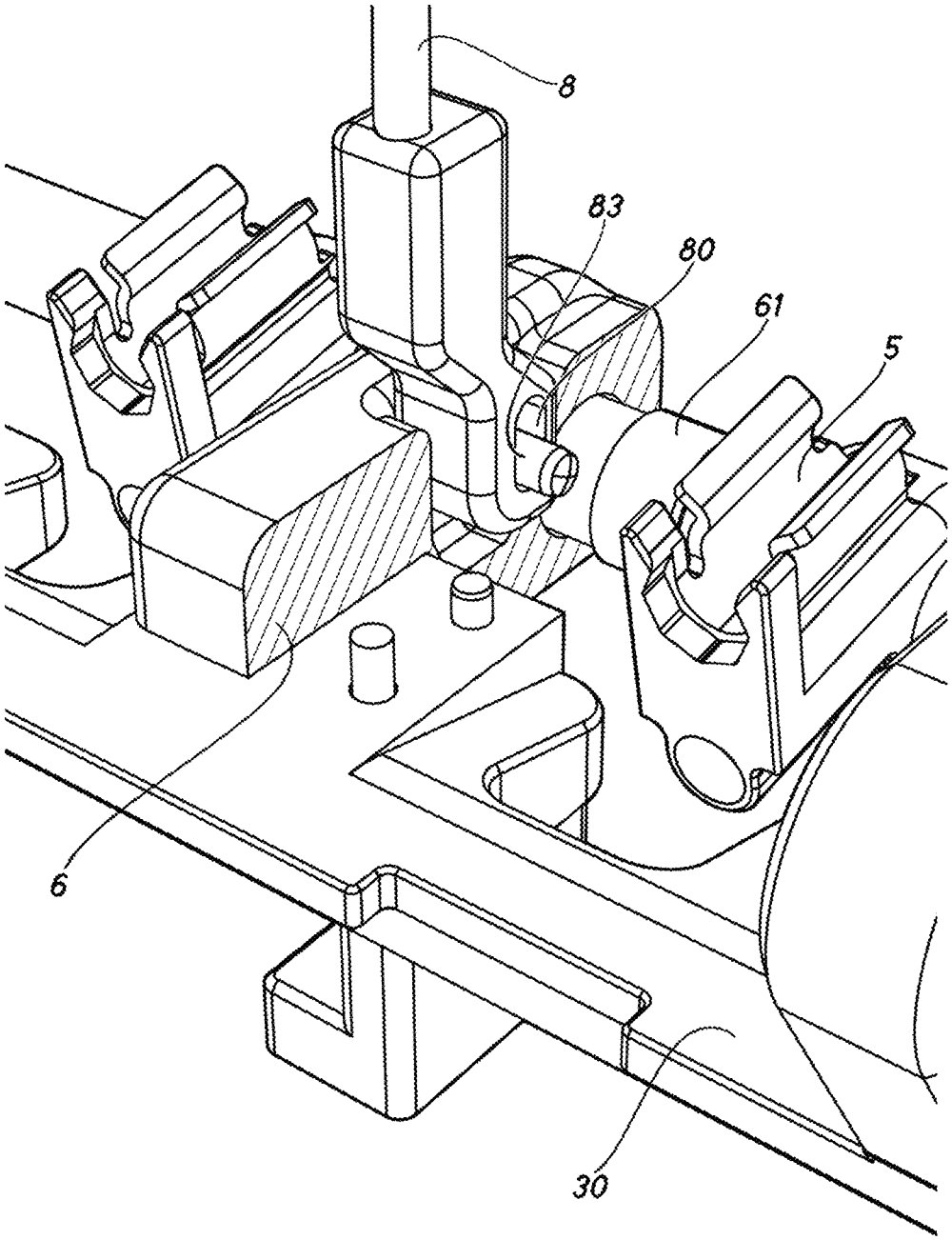
FIG. 9 is a perspective view of the connection structure of the device, with the connection structure shown in cross section.

FIG. 9 shows a cross sectioned structure 6. The connection structure 6 is secured to the rear portion 30 of the device (for example, by screwing, not shown in the figure) and receives the shaft 1. FIG. 9 shows an elongate hole or groove 80 of a lateral segment which supports a cross-piece, and also a through-element 83 arranged in said groove and rigidly connected to the connection structure 6 of the device. The dimensions of the groove 80 of the cross-piece 8 are greater than those of the through-element, such that on positioning the cross-piece parallel to the direction of the groove, the cross-piece falls until being placed on the through-element, locking said cross-piece. To unlock the cross-piece and allow a retraction movement thereof, the operator must pull the cross-piece upwards. FIG. 9 also shows that the structure 6 comprises brackets 61 for securing said structure to the shaft 1. One of the brackets, the one corresponding to the cross sectioned portion of the structure, can be seen in this figure, with a second bracket arranged on the portion of the structure not shown in cross section.

Figure 10:
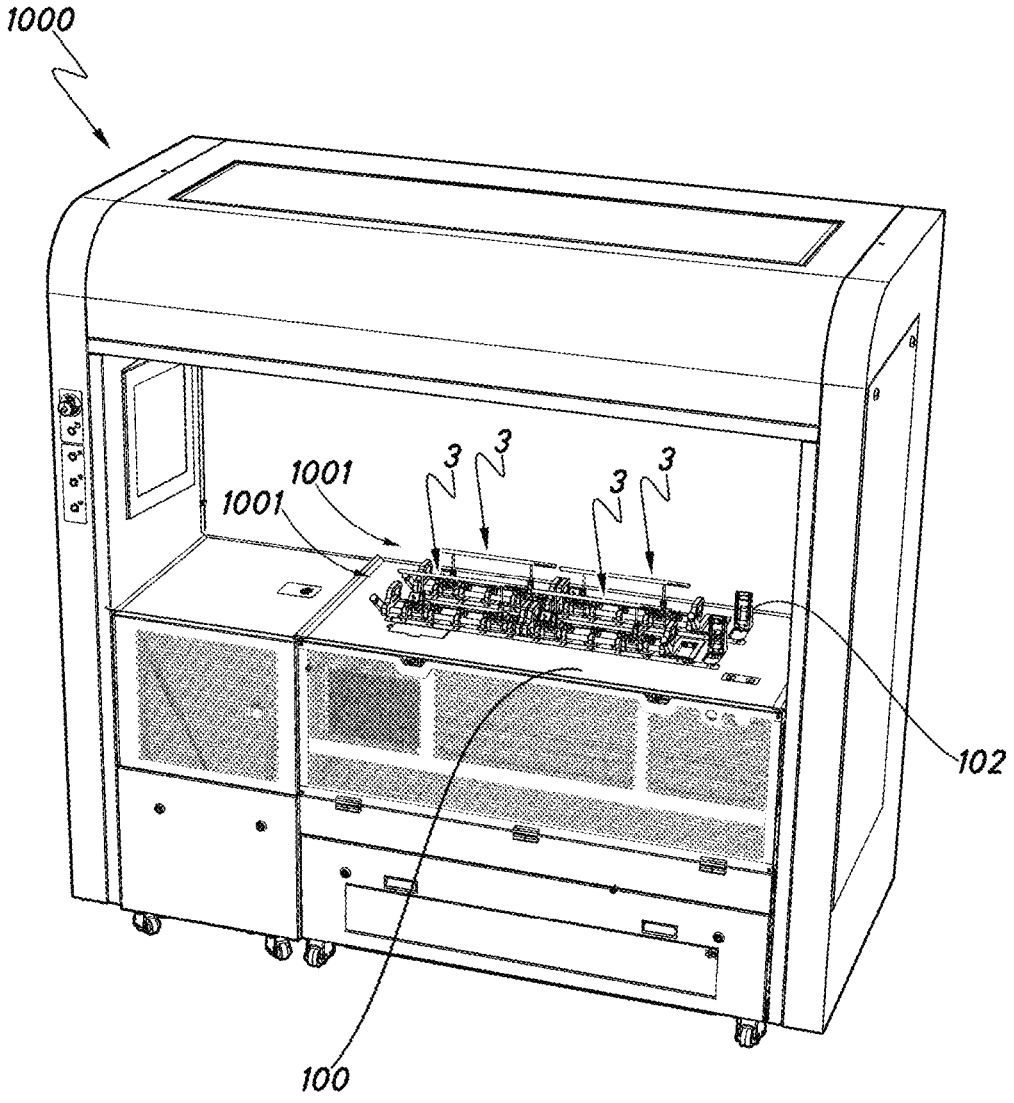
FIG. 10 is a perspective view of a machine for the preparation of medical products with the device placed on the worktop of the machine.

FIG. 10 shows the machine 1000 according to the second embodiment, with four devices 3 for loading bags, placed on the worktop 100 of the machine 1000. The figure shows two work lines 1001 of the machine, one of the two lines 1001 having two devices 3 placed in each of the elongated supports 200 of the worktop 100. The devices 3 situated on the left of the worktop are devices having the lever arranged on the left of the device 3, whereas the devices 3 situated on the right of the worktop are devices having the lever arranged on the right of the device 3. This distribution is preferable to facilitate actuation of the levers once the devices 3 are placed on the worktop 100.

Figure 11:
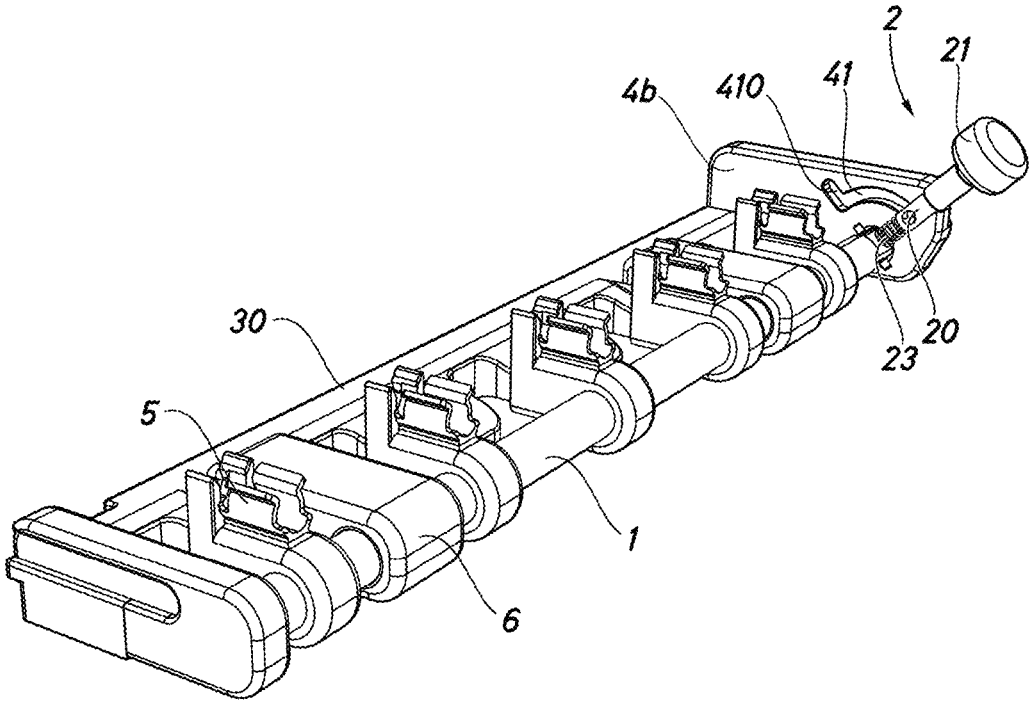
FIG. 11 is a perspective view of a bag loading device according to a first embodiment of the machine.

FIG. 11 shows an alternative embodiment in which the device or tray does not comprise any handles and in which the guide 41 is shown arranged on a wall **4*b*** of the device. More specifically, the guide is on the inner portion of the wall of the device. The rest of the elements and the functioning of the machine are the same or similar to those described for the previous embodiment and have been identified with the same reference numerals.

Although the invention has been described and illustrated based on representative examples, it should be understood that said embodiment given as an example in no way limits the present invention, and therefore any variations included directly or by equivalence in the content of the accompanying claims, should be considered included within the scope of the present invention.

What is claimed is:

1. A machine for the preparation of medical product which has a device for loading a medical product in said machine, wherein said device comprises a shaft with the ability to rotate, a plurality of adaptors for housing injection points of bags of medical product which are arranged on the shaft, the rotation of the shaft causing the adaptors to rotate, and two stops which limit the rotation of the shaft, said stops defining a position for loading bags by an operator and an operating position of the machine, wherein the device for loading the medical product comprises a lever mechanically connected to the shaft, said lever configured such that actuation of the lever causes the shaft to rotate.

2. The machine according to claim 1, wherein the operating position of the machine is a position in which the injection points of the bags are positioned beneath a worktop of the machine.

3. The machine according to claim 1 further comprising a guide, the ends of which define the stops.

4. The machine according to claim 1 further comprising a guide, the ends of which define the stops, wherein the lever comprises a protrusion, said protrusion of the lever being housed in the guide, the protrusion being guided by said guide during the actuation of the lever.

5. The machine according to claim 4, wherein the guide comprises a curved central segment and end segments situated at the ends of the central segment, there being a change of direction between the central segment and the end segments, such that the end segments correspond to the bag loading position for the operator and the operating position of the machine.

6. The machine according to claim 5, wherein the lever comprises an actuator with a pusher and elastic position recovery means for the pusher, such that the actuator allows the relative position of the protrusion with respect to the lever to be modified, facilitating the passage of the lever from the end segments to the central segment and vice versa.

7. The machine according to claim 1, wherein the device for loading bags of medical product comprises handles for manual handling.

8. The machine according to claim 1, wherein the adaptors comprise push-fitting means for injection points of the bags of medical product.

9. The machine according to claim 1 further comprising a cross-piece for supporting bags of medical product in the operating position of the machine.

10. A method for loading bags of medical product into a machine for the preparation of the medical product by the machine of claim 1, which comprises:

a. placing the device in the bag loading position for the operator;

b. fastening the bags in the adaptors; and c. rotating the shaft from the operator bag loading position to the machine operating position.

* * * * *